US007573784B2

(12) United States Patent
Choi

(10) Patent No.: US 7,573,784 B2
(45) Date of Patent: Aug. 11, 2009

(54) METHOD FOR SETTING UP A WAKE-UP ALARM OF A MOBILE COMMUNICATION TERMINAL

(75) Inventor: Won-Ho Choi, Gyeonggi-Do (KR)

(73) Assignee: LG Electronics, Inc., Seoul (KR)

( * ) Notice: Subject to any disclaimer, the term of this patent is extended or adjusted under 35 U.S.C. 154(b) by 401 days.

(21) Appl. No.: 11/110,705

(22) Filed: Apr. 21, 2005

(65) Prior Publication Data

US 2005/0237862 A1 Oct. 27, 2005

(30) Foreign Application Priority Data

Apr. 22, 2004 (KR) ..... 10-2004-0027951

(51) Int. Cl.
*G04B 23/02* (2006.01)

(52) U.S. Cl. ..... 368/245; 368/248
(58) Field of Classification Search ..... 368/243–245, 368/248
See application file for complete search history.

(56) References Cited

U.S. PATENT DOCUMENTS

| | | | | |
|---|---|---|---|---|
| 5,442,600 | A | 8/1995 | Kutosky | |
| 6,477,117 | B1 * | 11/2002 | Narayanaswami et al. | 368/243 |
| 2002/0024540 | A1 * | 2/2002 | McCarthy | 345/844 |
| 2003/0142591 | A1 | 7/2003 | Baweja et al. | |
| 2005/0237164 | A1 * | 10/2005 | Finkelstein et al. | 340/309.16 |

FOREIGN PATENT DOCUMENTS

JP 58189579 11/1983

OTHER PUBLICATIONS

USPTO Calendar/Planner User's Guide—pp. 8, 9 and cover (Feb. 2001).*

* cited by examiner

*Primary Examiner*—Renee S Luebke
*Assistant Examiner*—Sean Kayes
(74) *Attorney, Agent, or Firm*—Birch, Stewart, Kolasch & Birch, LLP

(57) ABSTRACT

In a method for setting a wake-up alarm of a mobile communication terminal, when a user presses a key of a mobile communication terminal to stop a wake-up alarm, it is determined whether the pressed key is a number key. If so, a snooze time is arithmetically set using a basic time, stored in the terminal, and the value of the number key pressed by the user, such as by addition or multiplication. Therefore, the user may immediately control the snooze time after an alarm. Also, the user may independently set a sound type and/or volume level associated with the wake-up alarm and any subsequent follow-up alarms.

20 Claims, 2 Drawing Sheets

METHOD FOR SETTING UP A WAKE-UP ALARM OF A MOBILE COMMUNICATION TERMINAL

This application claims the benefit of Korean Application No. 10-2004-0027951 filed Apr. 22, 2004, the entire contents of which are hereby incorporated by reference.

BACKGROUND OF THE INVENTION

1. Field of the Invention

The present invention relates to a mobile communication terminal, and particularly, to a method for setting up an alarm and subsequent follow-up alarms of a mobile communication terminal.

2. Description of the Background Art

In general, a mobile communication service provider provides a user with functions related to communications, such as allowing wireless Internet connections, performing text and multimedia message transmissions, accessing wireless on-line games, or the like. However, a mobile communication terminal manufacturer also provides the user with functions that are performed by the mobile communication terminal itself, without being related to the communication functions provided by the service provider. For example, the manufacturer can equip the terminal to perform such functions as storing a phone-book, a memo keeper, a schedule organizer, a calculator, and an alarm function, such as a wake-up alarm/call (morning call).

The alarm function may include a snooze function, which provides follow-up alarms after a period of time, if the user does not cancel the alarm, but only activates a snooze function of the terminal. The snooze function prevents the user from continuously sleeping or falling back to sleep, after stopping the alarm that rings (or provides another type of output to wake the user) at the user's set designated wake-up time. By the snooze function, when the user initially stops the alarm, the alarm rings again after a predetermined time (e.g., five minutes).

The mobile communication terminal outputs the alarm (e.g., by providing an alarm sound) at the wake-up time set by the user. During the alarm, if the user temporarily stops the alarm, by opening and closing a folding flap of the terminal or pressing a certain key without properly canceling (e.g. releasing) the wake-up alarm/call, a follow-up alarm is outputted after predetermined periods of time (e.g., every 5 minutes), in accordance with the snooze function.

FIG. 1 illustrates a flow chart showing a method for controlling a wake-up call of a mobile communication terminal, in accordance with the background art. As shown, when a wake-up time, that the user previously set in a mobile communication terminal, has been reached, a wake-up call alarm starts to sound as a bell sound (melody) (S100 and S110). When the wake-up call is output (rings), the user normally cancels the wake-up alarm/call or temporarily stops the alarm. If the user opens and closes the folding flap of the terminal or presses a certain key, the wake-up call is not completely canceled but only the alarm sound is stopped (S120 and S130).

When the alarm is stopped by the user more than once, the mobile communication terminal determines whether the number of times the alarm is stopped exceeds a pre-set maximum number of times the alarm may be stopped (S140). If the determination shows that the number exceeds the maximum number of times, the wake-up call alarm is stopped and the wake-up call is actually canceled. However, if the number of times that the alarm is stopped does not exceed the maximum number of times, the wake-up call alarm sounds again after a snooze time, stored in the terminal as a default time value by the manufacturer of the terminal (S150, and S110).

The background art method, described as above, has drawbacks. The snooze time interval is set and stored by the manufacturer of the terminal. There is no provision to allow the user/owner of the terminal to set a custom snooze time interval or progressive snooze time intervals. Therefore, the convenience and flexibility of the terminal is reduced. Also, the manufacturer sets the buzzer or alarm sound associated with the wake-up alarm and the snooze alarm. There is no provision to allow the user/owner of the terminal to set a custom sound for the wake-up alarm and/or snooze (e.g. follow-up) alarm, which may be different from each other, e.g. progressively louder.

SUMMARY OF THE INVENTION

Therefore, it is an object of the present invention to overcome one or more of the drawbacks associated with the background art.

It is an object of the present invention to provide a method for setting an alarm function of a mobile communication terminal enabling a user to quickly and easily set a snooze time, or follow-up alarm time interval.

It is an object of the present invention to provide a method for setting an alarm function of a mobile communication terminal enabling a user to pick an alarm sound for the initial alarm and/or follow-up alarm at the user's discretion.

To achieve these and other advantages and in accordance with the purpose of the present invention, as embodied and broadly described herein, there is provided a method of providing time-based alarms for a mobile communication terminal, the method comprising: outputting an initial alarm; receiving an input of a user selected key or action upon the mobile communication terminal, while the initial alarm is outputted; setting a follow-up alarm time interval based upon a basic time interval and the received input of the user selected key or action upon the mobile communication terminal; waiting for a duration of the follow-up alarm time interval; and outputting a follow-up alarm.

To achieve these and other advantages and in accordance with the purpose of the present invention, as embodied and broadly described herein, there is also provided a method of providing a time-based alarm for a mobile communication terminal, the method comprising: receiving a user's input of a desired alarm time for outputting an initial alarm; receiving a user's input of a desired alarm output format for outputting the initial alarm, wherein the user's desired alarm output format may be selected from a plurality of different sounds; and outputting the initial alarm at the user's desired alarm time in the form of the user's desired alarm output format.

Preferably, an alarm sound and volume of the wake-up alarm and/or follow-up alarm of the mobile communication terminal may be voluntarily set by a user.

Preferably, a time interval between the wake-up alarm and the follow-up alarm may be voluntarily set by the user.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An aspect of the present invention is to provide a method for improving the convenience of a wake-up alarm of a mobile communication terminal by permitting a user to easily and quickly set a desired snooze time interval until a follow-up alarm is given. Previously, the snooze time interval was fixed and set as a default value by a terminal manufacturer. Another aspect of the present invention allows a user to voluntarily select a bell sound, ringing sound or any other sound or melody associated with the initial wake-up alarm and/or the follow-up alarms, as desired by the user.

Figure 1:
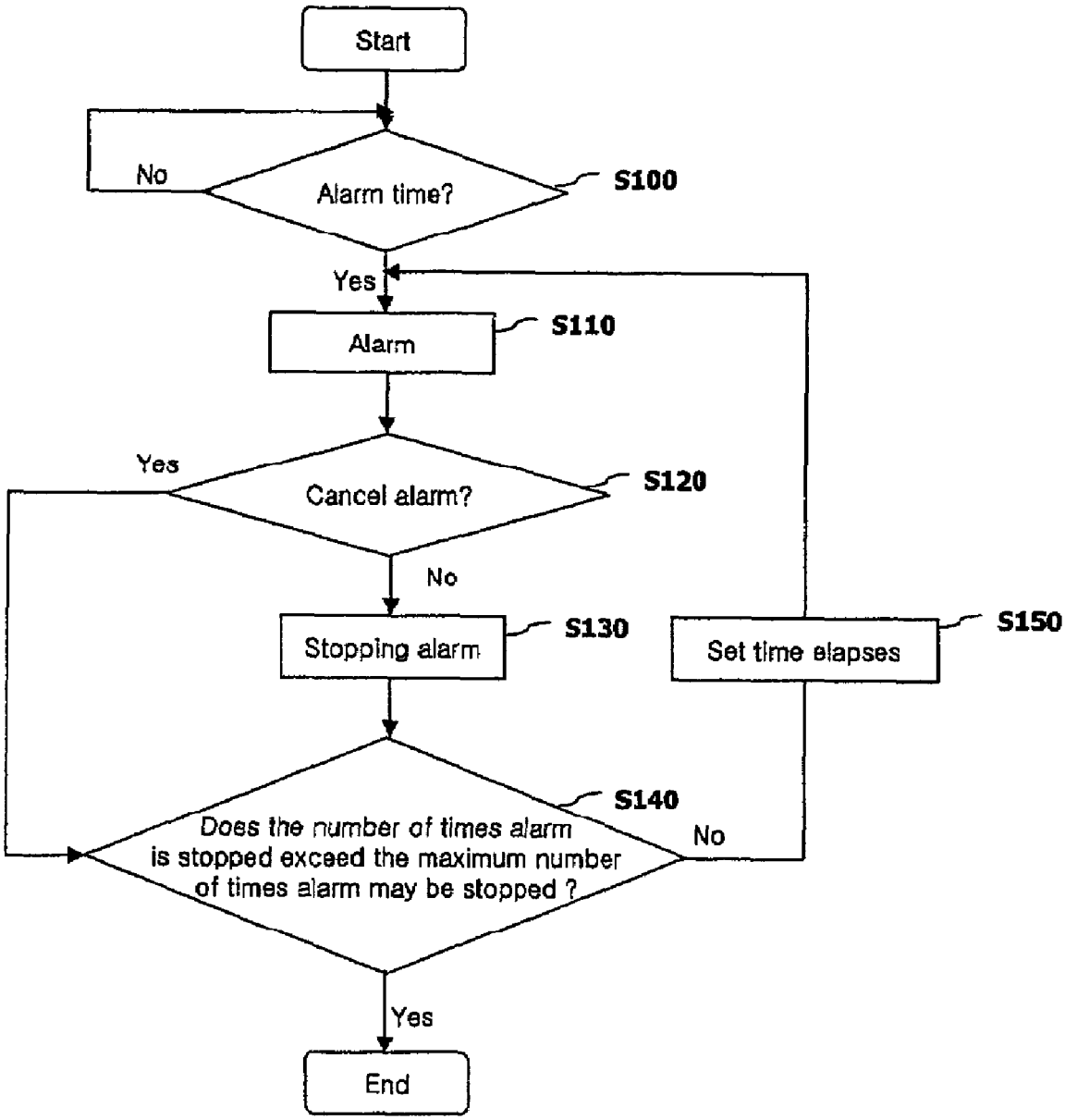
FIG. 1 RELATED ART
FIG. 1 illustrates a flow chart of a method for controlling a wake-up alarm and follow-up alarms of a mobile communication terminal, in accordance with the background art.
Figure 2:
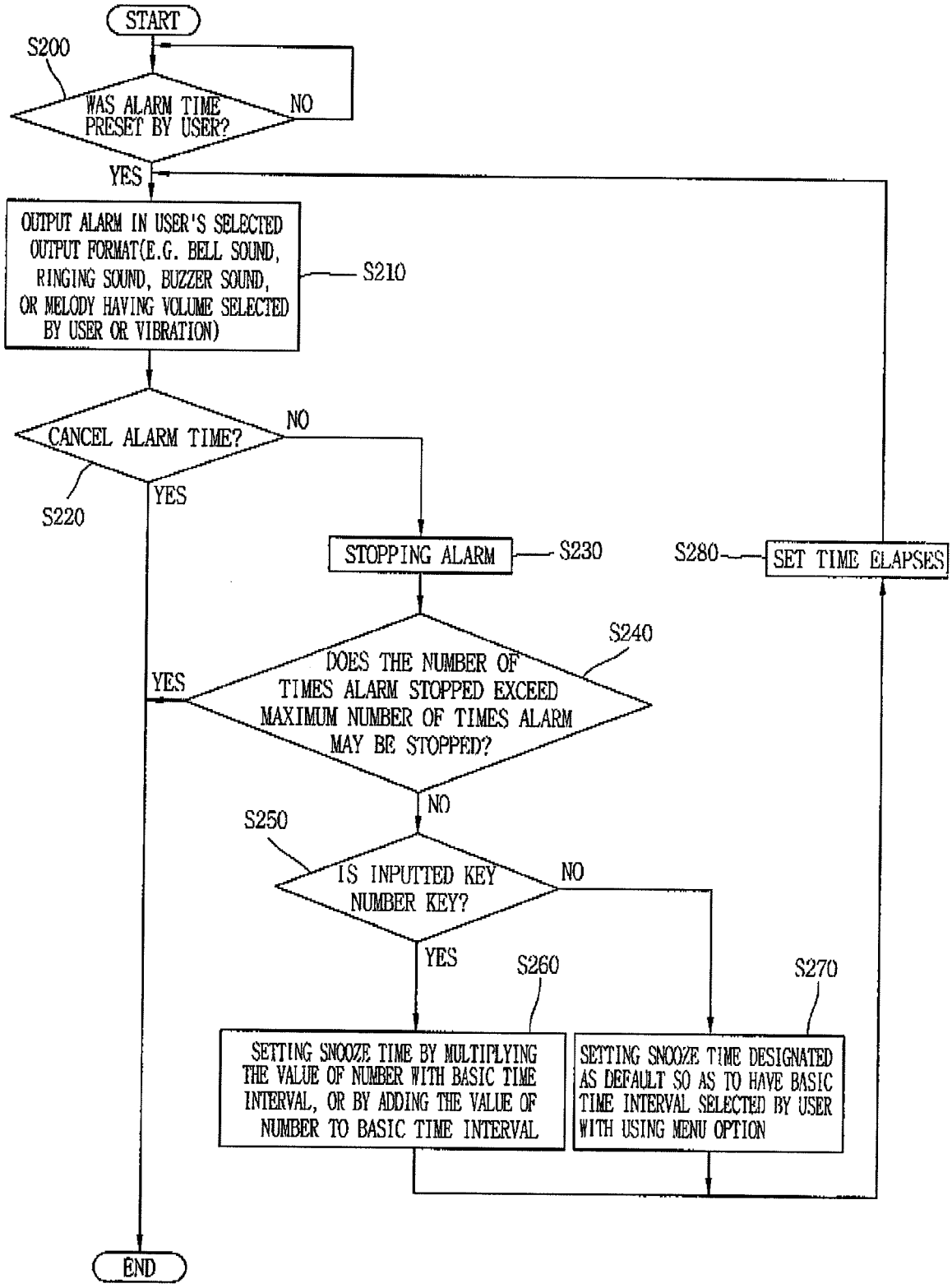
FIG. 2 illustrates a flow chart of a method for controlling a wake-up alarm and follow-up alarms of a mobile communication terminal, in accordance with the present invention.

FIG. 2 illustrates a flow chart of an exemplary method for setting a wake-up alarm of the mobile communication terminal, in accordance with the present invention. First, a user interacts with a menu of the mobile communication terminal to store several desired parameters. For example, the user sets a desired wake-up alarm time, the user selects a desired sound for the initial wake-up alarm; and the user selects a basic time interval for use in calculating a snooze time, as will be described in more detail to follow. As illustrated in FIG. 2, in Step S200, a timer provided in the terminal monitors for the set wake-up time. When the wake-up time set by the user is reached, in step S210, the initial wake-up alarm is outputted using the user's selected output format (e.g. bell sound, ringing sound, buzzer sound, vibration or melody).

When the initial alarm is outputted, the user has the option of canceling the initial alarm or temporarily stopping the initial alarm. If the initial alarm is canceled, no follow-up alarm will be issued by the terminal. If the alarm is merely stopped, a follow-up alarm will be issued by the terminal after the passing of a snooze time interval. In step S220, it is checked whether or not the user canceled the alarm. If the user presses (selects or inputs) a certain key (e.g., a cancel key or a '0' key), the wake-up call alarm is canceled. However, if the user opens and closes a flap of the terminal (e.g. a flap including an display which normally covers a keypad of the terminal) or presses another key (e.g., not the cancel key and the '0' key), the wake-up call is not completely canceled and the alarm is only stopped temporarily (step S230).

In step S240, it is determined whether or not the alarm has been stopped more than a pre-set maximum number of times. Once, the mobile communication terminal determines that the number of times the alarm has been stopped (e.g., by pressing other than the cancel key or the '0' key) exceeds the pre-set maximum number of times the alarm may be stopped, the alarm is completely canceled.

If the result of step S240 shows that the number of times the alarm has been stopped does not exceed the pre-set maximum number of times, the mobile communication terminal determines whether a key inputted by the user is a number key in step S250. If step S250 shows that the key that the user inputted on the mobile communication terminal to stop the alarm was a number key (excluding the '0' key), the terminal sets a certain time (e.g., a basic time preset in the terminal multiplied by the value of the number key selected by the user) as a snooze time interval, in step S260. Alternatively, the snooze time interval may be calculated by other methods, such as adding the basic time with the value of the number key selected by the user.

If the user opens and closes the flap of the terminal to stop the alarm or inputs another key which is not a number key, a default time is set as a snooze time in step S270. The default time can be equal to the basic time preset in the terminal.

After the snooze time interval elapses (step S280), the mobile communication terminal outputs a follow-up alarm (step S210), and the aforementioned process (steps S220~S240) are performed again. If the number of times the alarm is stopped exceeds the maximum number of times the alarm may be stopped at step S240, the wake-up call is canceled.

As described above, the present invention allows the user to quickly select a desired snooze time interval. Therefore, if the user desires a five minute snooze time, a ten minute snooze time, a fifteen minute snooze time, or a thirty minute snooze time, such could be quickly accomplished at the time of the initial alarm by pressing the number keys "1", "2", "3", or "6" respectively (assuming that the basic time preset in the terminal is five minutes and that the basic time is multiplied by the value of the number key pressed). Alternatively, if the user desires an eleven minute snooze time, a twelve minute snooze time, a fifteen minute snooze time, or a nineteen minute snooze time, such could be quickly accomplished at the time of the initial alarm by pressing the number keys "1", "2", "5", or "9" respectively (assuming that the basic time preset in the terminal is ten minutes and that the basic time is added to the value of the number key pressed).

The basic time interval, stored in the terminal, may be initially set by the mobile terminal manufacturer to a value such as five minutes or ten minutes. However, in an alternate embodiment of the present invention, the basic time interval is set by the user of the terminal as a setup menu option.

In the setup menu, the user could also select the alarm output format of the initial wake-up alarm and/or the follow-up alarms. For example, the alarm output format could be selected from various bell sounds, ring tones, buzzers, melodies, or a vibrate mode. Also, the user could select different alarm output formats for the initial alarm as compared to the follow-up alarm. For instance, the initial alarm could be a soothing melody, the first follow-up alarm could be an aggressive melody, and the third and subsequent follow-up alarms could be buzzers. Also, the user could select the volume level for the initial and subsequent follow-up alarms. For instance, the initial alarm could be moderate in volume, and the follow-up alarms could be sequentially louder in volume.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

I claim:

1. A method of providing time-based alarms for a mobile communication terminal, the method comprising:

outputting an initial alarm;

receiving an input of a user selected number key upon the mobile communication terminal, while the initial alarm is outputted;

setting a follow-up alarm time interval based upon a basic time interval and an additional amount of time based on a value of the received input of the user selected number key;

waiting for a duration of the follow-up alarm time interval; and outputting a follow-up alarm.

2. The method of claim 1, further comprising the steps of:

receiving a second input of a user selected key or action upon the mobile communication terminal, while the follow-up alarm is outputted;

setting a second follow-up alarm time interval based upon the basic time interval and the second received input of the user selected key or action upon the mobile communication terminal;

waiting for a duration of the second follow-up alarm time interval; and outputting a second follow-up alarm.

3. The method of claim 1, wherein the basic time interval is stored in the mobile communication terminal and set by the manufacturer of the mobile communication terminal.

4. The method of claim 1, wherein the basic time interval is stored in the mobile communication terminal and selected by the user of the mobile communication terminal using a menu option.

5. The method of claim 1, further comprising setting the follow-up alarm time interval to equal the basic time interval by opening and closing a folding flap of the mobile communication terminal, while the initial alarm is being outputted.

6. The method of claim 1, further comprising canceling the initial alarm when the user selected key is a wake-up alarm cancel key or a '0' key.

7. The method of claim 1, wherein the initial alarm and the follow-up alarm are audible sounds.

8. The method of claim 7, wherein the audible sound of the initial alarm or the follow-up alarm is selected by the user.

9. The method of claim 7, wherein the volume of the audible sound of the initial alarm or the follow-up alarm is selected by the user.

10. The method of claim 7, wherein the audible sound of the initial alarm is selected by the user, and wherein the audible sound of the follow-up alarm is different from the audible sound of the initial alarm and selected by the user.

11. The method of claim 1, wherein at least one of the initial alarm and the follow-up alarm is a vibration of the mobile communication terminal.

12. The method of claim 1, wherein setting the follow-up alarm time interval is based upon a time interval determined by a preset amount of time multiplied by the value of a number key selected by the user as a snooze interval.

13. A method of providing time-based alarms for a mobile communication terminal, the method comprising:

outputting an initial alarm;

receiving an input of a user selected key upon the mobile communication terminal, while the initial alarm is outputted;

setting a follow-up alarm time interval based upon a basic time interval and the received input of the user selected key upon the mobile communication terminal;

waiting for a duration of the follow-up alarm time interval; and outputting a follow-up alarm, wherein the follow-up alarm time interval is set by multiplying a value associated with the user selected key with the basic time interval, when the user selected key is a number key.

14. A method of providing time-based alarms for a mobile communication terminal, the method comprising:

outputting an initial alarm;

receiving an input of a user selected key upon the mobile communication terminal, while the initial alarm is outputted;

setting a follow-up alarm time interval based upon a basic time interval and the received input of the user selected key upon the mobile communication terminal;

waiting for a duration of the follow-up alarm time interval; and outputting a follow-up alarm, wherein the follow-up alarm time interval is set by adding a value associated with the user selected key with the basic time interval, when the user selected key is a number key.

15. A method of providing time-based alarms for a mobile communication terminal, the method comprising:

receiving a user's input of a desired alarm time for outputting an initial alarm;

receiving a user's input of a desired alarm output format for outputting the initial alarm, wherein the user's desired alarm output format may be selected from a plurality of different sounds;

outputting the initial alarm at the user's desired alarm time in the form of the user's desired alarm output format;

receiving an input of a user selected number key while the initial alarm is outputted;

setting a follow-up alarm time interval based upon a basic time interval and an additional amount of time based on a value of the received input of the user selected number key;

waiting for a duration of the follow-up alarm time interval; and outputting a follow-up alarm.

16. The method of claim 15, wherein the follow-up alarm time interval is set by multiplying the basic time interval by a value associated with the user selected number key.

17. A method of providing time-based alarms for a mobile communication terminal, the method comprising:

receiving a user's input of a desired alarm time for outputting an initial alarm;

receiving a user's input of a desired alarm output format for outputting the initial alarm, wherein the user's desired alarm output format may be selected from a plurality of different sounds;

outputting the initial alarm at the user's desired alarm time in the form of the user's desired alarm output format;

receiving an input of a user selected key upon the mobile communication terminal, while the initial alarm is outputted;

setting a follow-up alarm time interval based upon a basic time interval and the received input of the user selected key upon the mobile communication network;

waiting for a duration of the follow-up alarm time interval; and outputting a follow-up alarm, wherein the follow-up alarm time interval is set by multiplying a value associated with the user selected key with the basic time interval, when the user selected key is a number key.

18. A method of providing time-based alarms for a mobile communication terminal, the method comprising:

receiving a user's input of a desired alarm time for outputting an initial alarm;

receiving a user's input of a desired alarm output format for outputting the initial alarm, wherein the user's desired alarm output format may be selected from a plurality of different sounds;

outputting the initial alarm at the user's desired alarm time in the form of the user's desired alarm output format;

receiving an input of a user selected key upon the mobile communication terminal, while the initial alarm is outputted;

setting a follow-up alarm time interval based upon a basic time interval and the received input of the user selected key upon the mobile communication network;

waiting for a duration of the follow-up alarm time interval; and outputting a follow-up alarm, wherein the follow-up alarm time interval is set by adding a value associated with the user selected key with the basic time interval, when the user selected key is a number key.

19. A method of providing time-based alarms for a mobile communication terminal, the method comprising:

receiving a user's input of a desired alarm time for outputting an initial alarm;

receiving a user's input of a desired alarm output format for outputting the initial alarm, wherein the user's desired initial alarm output format may be selected from a plurality of different sounds;

outputting the initial alarm at the user's desired alarm time in the form of the user's desired alarm output format;

receiving an input of a user selected key upon the mobile communication terminal, while the initial alarm is outputted;

setting a follow-up alarm time interval based upon a basic time interval and the received input of the user selected key upon the mobile communication network;

waiting for a duration of the follow-up alarm time interval;

outputting a follow-up alarm; and receiving a user's input of a desired alarm output format for outputting the follow-up alarm, wherein the user's desired follow-up alarm output format may be selected from a plurality of different sounds, and may be selected to be different from the alarm output format of the initial alarm.

20. A method of providing time-based alarms for a mobile communication terminal, the method comprising:

outputting an initial alarm;

receiving an input of a user selected number key upon the mobile communication terminal, while the initial alarm is outputted;

setting a follow-up alarm time interval based upon a basic time interval plus an additional time interval corresponding to a value of the user selected number key;

waiting for a duration of the follow-up alarm time interval; and outputting a follow-up alarm.

* * * * *